US009980530B2

(12) United States Patent
Hassan

(10) Patent No.: US 9,980,530 B2
(45) Date of Patent: May 29, 2018

(54) OPTIMIZED VISUAL FIELD HELMETS

(71) Applicant: Adam S. Hassan, Ada, MI (US)

(72) Inventor: Adam S. Hassan, Ada, MI (US)

( * ) Notice: Subject to any disclaimer, the term of this patent is extended or adjusted under 35 U.S.C. 154(b) by 78 days.

(21) Appl. No.: 14/037,828

(22) Filed: Sep. 26, 2013

(65) Prior Publication Data

US 2015/0082521 A1 Mar. 26, 2015

(51) Int. Cl.
*A42B 3/06* (2006.01)

(52) U.S. Cl.
CPC ..... *A42B 3/061* (2013.01)

(58) Field of Classification Search
CPC ..... A42B 3/061
USPC ..... 2/413
See application file for complete search history.

(56) References Cited

U.S. PATENT DOCUMENTS 2,816,290 A * 12/1957 Boyer ..... A42B 3/14 2/413
3,766,565 A * 10/1973 Cozzens ..... A42C 5/04 2/195.1
3,885,246 A * 5/1975 Tung ..... A42B 3/061 2/412
5,014,366 A * 5/1991 Discipio, Sr. ..... A42B 3/061 2/410
5,101,517 A 4/1992 Douglas
5,525,290 A * 6/1996 Carpenter ..... 264/510
5,539,936 A 7/1996 Thomas
5,588,156 A * 12/1996 Panton, Jr. ..... 2/243.1
6,038,704 A * 3/2000 Crescentini ..... 2/410
6,153,128 A * 11/2000 Lightle ..... G02B 5/128 264/1.9
6,305,028 B1 * 10/2001 Lin ..... 2/410
6,671,889 B2 * 1/2004 Dennis et al. ..... 2/411
7,299,574 B2 * 11/2007 Dome ..... G09F 13/16 40/329
7,649,700 B1 1/2010 Diemer
7,988,313 B2 * 8/2011 Kutnyak ..... A42B 3/044 2/422
2002/0157173 A1 * 10/2002 Murasko ..... G09F 21/02 2/425
2003/0001296 A1 * 1/2003 Andersson ..... B29C 51/02 264/1.9
2007/0226882 A1 * 10/2007 Ryan ..... 2/426
2009/0083891 A1 * 4/2009 Cote ..... 2/9
(Continued)

*Primary Examiner* — Katherine Moran
(74) *Attorney, Agent, or Firm* — John G. Posa; Belzer PC

(57) ABSTRACT

A sports helmet optimizes the full peripheral field of vision of its wearer. The optical properties of the entire protective shell will allow the transmission of light, while reflecting a colored appearance externally, and remaining antireflective from the eye of the wearer. Internal padding and face guard also enhance the transmission of light compared to existing designs. Helmets constructed in accordance with the invention are made with a transparent shell material, with one or more optical layers to achieve an anti-reflective view from the eye side of the helmet and an acceptable appearance on the external surface of the shell. Single or multiple metalized thin films may be used to create a one-way mirror effect. In other embodiments see-through graphics may be used with microdot patterns. In certain embodiments, multiple optical coatings may be used to achieve a desired combination of transparency and light-absorbing properties.

18 Claims, 5 Drawing Sheets

(56) References Cited

U.S. PATENT DOCUMENTS

2010/0162471 A1* 7/2010 Tsai ..... 2/410
2013/0280446 A1* 10/2013 Rivera, III ..... B44F 1/10
428/29

* cited by examiner

OPTIMIZED VISUAL FIELD HELMETS

FIELD OF THE INVENTION

The present invention relates to protective helmets and, in particular, to helmets and devices having one or more applied layers to transmit light to a user to improve their visibility while imparting a desired appearance to outside observers.

BACKGROUND OF THE INVENTION

The CDC estimates over 3.8 million sports related concussions occur per year, with many occurring in high impact sports with head gear such as football. Over the years, various helmet configurations have offered protection from the impact of physical trauma to the head. However, the function of existing designs has been limited to providing a hard cushioned surface between the head and the impacting object/source.

The peripheral field of vision is typically measured using perimetry. Ophthalmologists using automated or manual equipment generally conduct perimetry testing to estimate how large the field of vision of an individual is. The field of vision is studied 360 degrees around a central plain (vertically, horizontally, and obliquely). As shown in FIGS. 1A, B, the human visual field has the potential to see 190 degrees horizontally and 135 degrees vertically (55-60 degrees superiorly) when in a primary forward gaze. Superior visual field increases to near 90 degrees with eye movement.

Present helmet designs have markedly restricted the visual field of its user. While there are proposed designs which improve some aspects of visibility, they fail to suggest an improved horizontal/lateral, vertical/up-down, and oblique/tangential peripheral field of view. While lateral field of view is moderately improved in these designs, up-down and oblique visibility remains essentially the same. U.S. Pat. No. 5,101,517 to Douglas, for example, resides in a sports helmet with transparent windows in the side walls. The windows are located so as to be laterally of and rearwardly of the eyes of the wearer to increase the peripheral vision of the wearer.

U.S. Pat. No. 5,539,936 to Thomas discloses a transparent guard assembly adapted for use in association with a sports helmet having opposing side regions with C-shaped recesses positioned therein. The guard device, fabricated of transparent materials, is said to provide users with increased peripheral visibility. U.S. Pat. No. 7,649,700 to Diemer is directed to providing enhanced peripheral vision to a wearer of a helmet. At least one lens member, adapted to be received at a predetermined location in the helmet, is operable to direct light from a side portion of the helmet to a location adjacent the eyes of a wearer of the helmet.

A helmet wearer's full peripheral visual field includes a near maximal potential at 180 degrees from a vertical meridian and 135 degrees (55-60 degrees up and 70-75 degrees down) above and below a horizontal meridian. However, as shown in FIG. 1A and 1B, in the case of existing football helmets, up/down visibility is obscured, particularly in areas such as 102, and in the entire area (arc) obliquely present between the vertical and horizontal planes. In addition, horizontal side-to-side visibility is truncated as well. There is an outstanding need, therefore, for a helmet structure that removes these impediments. With enough visibility, more athletes could completely or partially avoid collisions, which will ultimately lessen the force of a given impact from a physical trauma to the head.

SUMMARY OF THE INVENTION

This invention improves upon existing sports helmets by improving the peripheral visual field in all fields—horizontal, vertical, and oblique. The user is able to see and identify more sources of trauma before an object comes close to his/her head, if not preventing them completely from getting close to his/her body, offering more than passive protection to the very vital parts of the body, namely the head, skull, eyes and brain.

In the preferred embodiments, the entire helmet transmits light to the wearer having an anti-reflective effect on the eye, while providing a desired external color. An improved visibility helmet according to the invention comprises a transparent, semi-transparent or translucent shell; and one or more coatings, films or layers on or in the shell that (1) transmit sufficient light to improve the wearer's horizontal/lateral, vertical/up-down, and oblique visibility, and (2) reflect some of the light to impart a desired appearance of the helmet to an outside observer.

The shell may be made from polycarbonate or other polymeric/plastic material, including transparent, semi-transparent or translucent padding within the shell. In some configurations, such as bicycle helmets, the shell is dimensioned to cover only the top portion of a wearer's head. In other configurations, such as football helmets, the shell also covers the ears. Any associated shield, cage or face mask may also be constructed of a transparent material in accordance with the invention.

In basic embodiments, the optical layer may include a paint or film, including a metalized paint or film on the outer and/or inner surface of the shell. Other paints or films may be added for informative or decorative purposes. Alternatively, see-through graphics, including those with a fine dot pattern, may be applied with a stencil or decal(s). In more sophisticated embodiments, a plurality of dielectrically formed transparent and/or light-absorbing layers may be used. Such layers may be composed of metal oxides, fluorides, or nitrides. Transparent layers may be thicker than light-absorbing layers.

DETAILED DESCRIPTION OF THE INVENTION

This invention is directed to sports helmets that improve the peripheral visual field in all fields, including horizontal, vertical, and oblique. The improvement in visual field yields both increased functionality and safety. To achieve this goal, helmets constructed in accordance with the invention are made with a transparent shell material, with one or more optical layers to achieve an anti-reflective view from the eye side of the helmet and an acceptable appearance on the external surface of the shell. In certain embodiments, multiple optical coatings may be used to achieve a desired combination of transparency and light-absorbing properties. Such optical coatings may be overlapping, with the thickness and quantity of the respective layers being selected to achieve an anti-reflective view from the eye side of the helmet and a desired color on the external surface of the shell.

In the preferred embodiments, the shell of the helmet is made of an optically clear polycarbonate plastic. In alternative embodiments, acrylics, bisphenols, allyl phthalates, styrenics, vinylics, polyesters, may be used. While a clear shell is preferred, semi-transparent and even translucent materials may be substituted and still improve a wearer's peripheral vision.

Figure 1A:
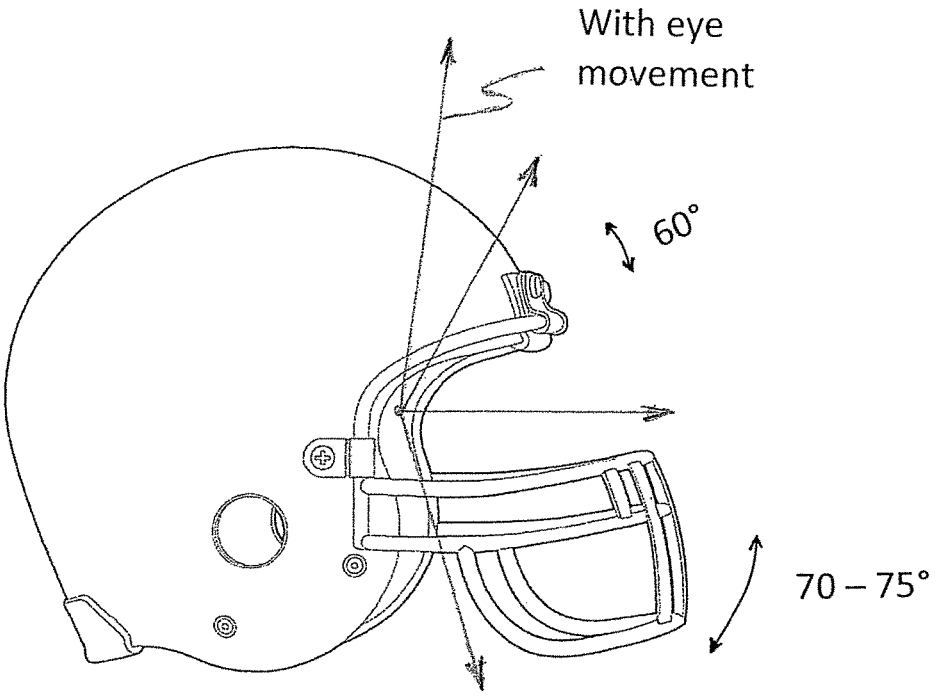
FIG – 1A PRIOR ART
FIG. 1A is a side view of a prior-art helmet displaying maximal visual field potential vertically or up-and-down.
Figure 1B:
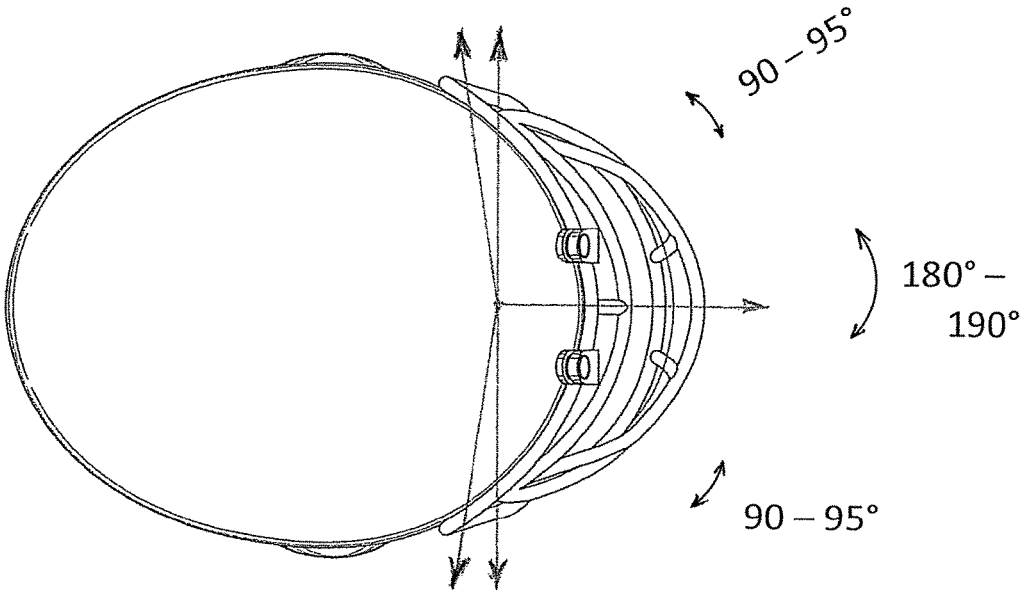
FIG – 1B PRIOR ART
FIG. 1B is a top-down view of a prior-art helmet displaying a maximal horizontal visual field potential of 180 degrees.
Figure 2:
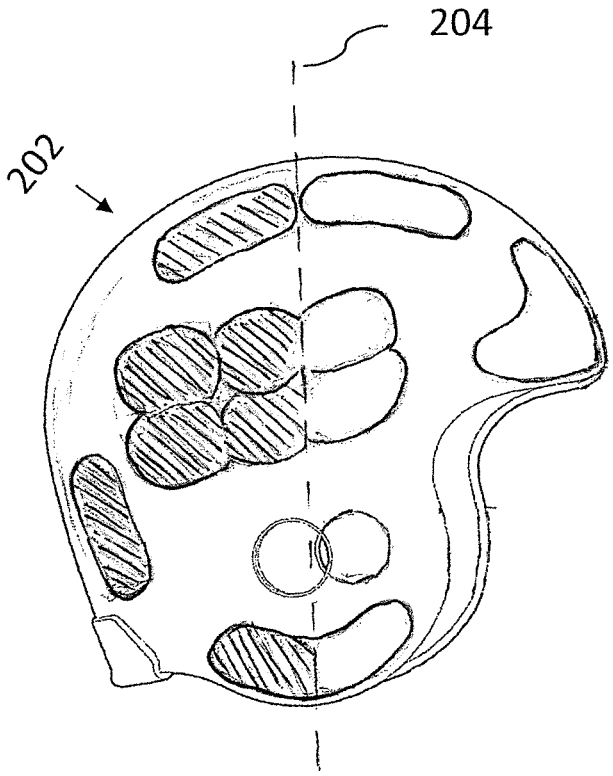
FIG. 2 is a side view of a transparent helmet shell constructed in accordance with the invention without facial protection or applied layers to reveal internal padding.

FIG. 2 is a side view of a transparent helmet shell 202 constructed in accordance with the invention, but without facial protection or optical layers to reveal internal padding. While pads behind a midline 204 may be conventional and indeed opaque, pads in front of line 204 are preferably transparent, semi-transparent or translucent, enabling a user to see or at least perceive shapes in the full ranges depicted in FIGS. 1A, 1B. As one example, such internal padding or liner may be made of transparent, flexible or soft plastic, such as vinyl or silicone, and may be filled with air, water or clear gel.

Beginning with a transparent helmet shell, one or more layers are applied on the outer and/or inner surface of the shell to transmit light to the wearer to improve their visibility while, at the same time, imparting a desired appearance to outside observers. In a basic configuration, the optical layer may include a paint or thin film, including a metalized paint or film. While it may be more difficult to spray such materials into the interior of the shell, this approach protects against the paint or film from being scraped away during play. Once the paint or film has been applied, text and/or graphics may be applied with other layers, including decals. Unless such for informational or decorative layers are also at least semi-transparent, they are preferably used behind mid-line 204 in FIG. 2.

Figure 3:
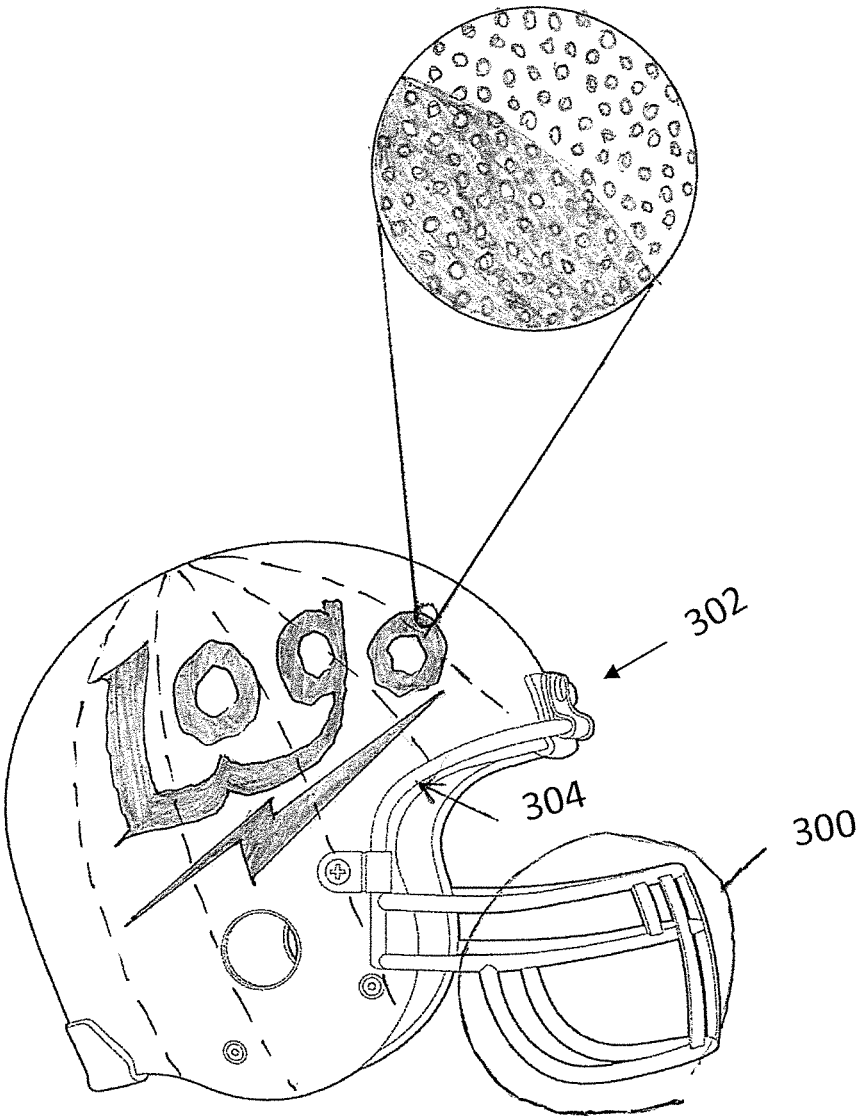
FIG. 3 illustrates an embodiment of the invention including see-through graphics applied to a transparent helmet shell.

FIG. 3 illustrates an embodiment of the invention including see-through graphics applied to a transparent helmet shell. Such graphics may be applied using a stencil or in decal form. A description of see-through graphical materials may be found at http://www.123grpr.com/clearfocus.php. Such materials typically feature 1.5-2 mm holes with a 65:35 to a 50:50 perforation pattern. Since most helmets have irregular, convex outer surfaces, a decal may be applied in strips or wedges and indicated with the broken lines. If the helmet requires a shield, cage or face mask, at least portions of such structures may also be constructed of a transparent, semi-transparent or translucent materials. For example, in FIG. 3, while structure 300 may need to be unbreakable metal for safety reasons, components adjacent the helmet such as 302, 304 may be transparent semi-transparent or translucent polycarbonate or other plastics. Guard portions 300 may also be made of steel wire with clear polycarbonate coating, also with multiple transparent and light absorbing coatings to achieve the desired color.

Figure 4:
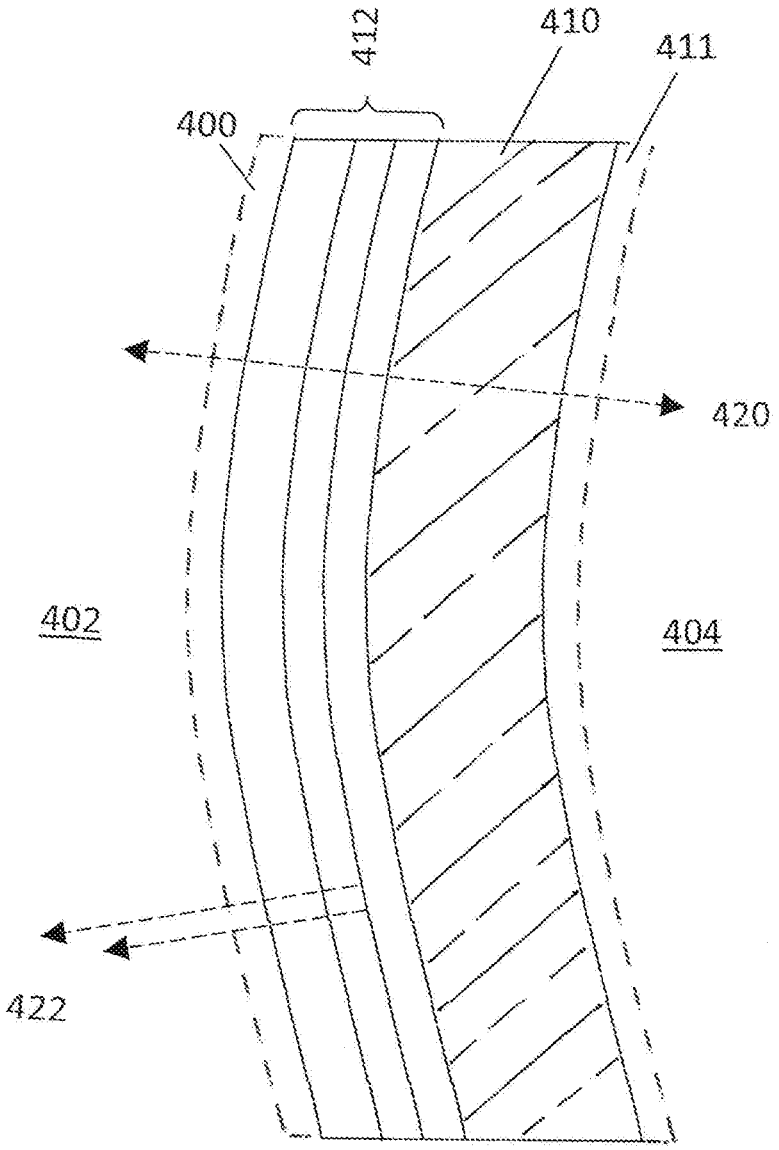
FIG. 4 is a cross section of a transparent helmet shell with transparent and light absorbing coatings of various thickness, producing a desired color externally and an anti-reflective effect on the eye side.

As shown in FIG. 4, multiple optical coatings may be used comprising various materials, thicknesses and/or orders of application over and/or within the shell to produce the desired results. Region 402 represents the exterior of the helmet; 404 the inside. Layer 410 is the transparent shell material. To this is applied transparent and light-absorbing layers 412 that enable a wearer 420 to see through the structure while reflecting colors, graphics, etc., to outside observers 422. FIG. 4 also shows at least one coating, film or layer 411 on the inner, concave surface of the shell 410.

The optical layers of FIG. 4 may be (but not exclusively) dielectric formed from metal oxides, fluorides, or nitrides (i.e., SiO, $SiO_2$, $ZrO_2$, $Al_2O_3$, TiO, $TiO_2$, $Ti_2O_3$, $Y_2O_3$, $Yb_2O_3$, MgO, $Ta_2O_5$, $CeO_2$, $HfO_2$, $MgF_2$, $AlF_3$, $BaF_2$, $CaF_2$, $Na_3AlF_6$, $Ta_2O_5$, $Na_5Al_3FIl_4$, $Si_3N_4$, or AlN. The transparent layers are generally thicker than the light absorbing layers. Light absorbing metallic layers may be used for silvering, including Niobium (Nb), Chromium (Cr), Tungsten (W), Tantalum (Ta), Tin (Sn), Palladium (Pd), Nickel (Ni), or Titantium (Ti). Additional light absorbing coatings of dielectric materials are used to achieve various colors visible from the outside of the helmet.

The coatings may be applied using physical vapor deposition such as vacuum evaporation, chemical vapor deposition, spin coating, curing, ion beam, layered adhesive placement, or other appropriate processes. In all embodiments using externally applied layers, a protective scratch or impact resistant coating 400 can be placed as a top coating. Such coatings may be made of organosilicone resin, for example. Alternative protective coating options include films such as diamond-like carbon and polycrystalline diamond films placed as the top coating. A scratch-resistant thin paint such as acrylic can be used over the reflective surface to achieve numerous color tints.

EXAMPLE 1

The shell of the helmet is made of an optically clear polycarbonate. A thin/sparse reflective coating is placed uniformly over the shell to achieve a half-silvered surface. This coating is typically made of aluminum metalizer. The reflective coating achieves a one-way mirror effect reflecting light from the external side, while remaining clear on the inside. A scratch resistant paint such as acrylic or metallic can be used over the reflective surface to achieve numerous color tints. A protective scratch resistant film such as diamond-like carbon and polycrystalline diamond is placed over the shell. Transparent silicone plastic is used for the foam padding.

EXAMPLE 2

The shell of the helmet is made of an optically clear polycarbonate. The transparent and light transmitting coatings are applied as a one-way viewing film to the shell, creating an exposed image or color externally, while transmitting light to the viewer. These films use a microdot pattern. Transparent silicone plastic is used for the foam padding.

EXAMPLE 3

The shell of the helmet is made of an optically clear polycarbonate. Various thicknesses of $SiO_2$ and Nb are used for light absorbing and transparent coatings, thereby achieving a blue external color. A $SiO_2$ coating is deposited as a final, scratch-resistance layer. Transparent silicone plastic is used for the foam padding.

Figure 5:
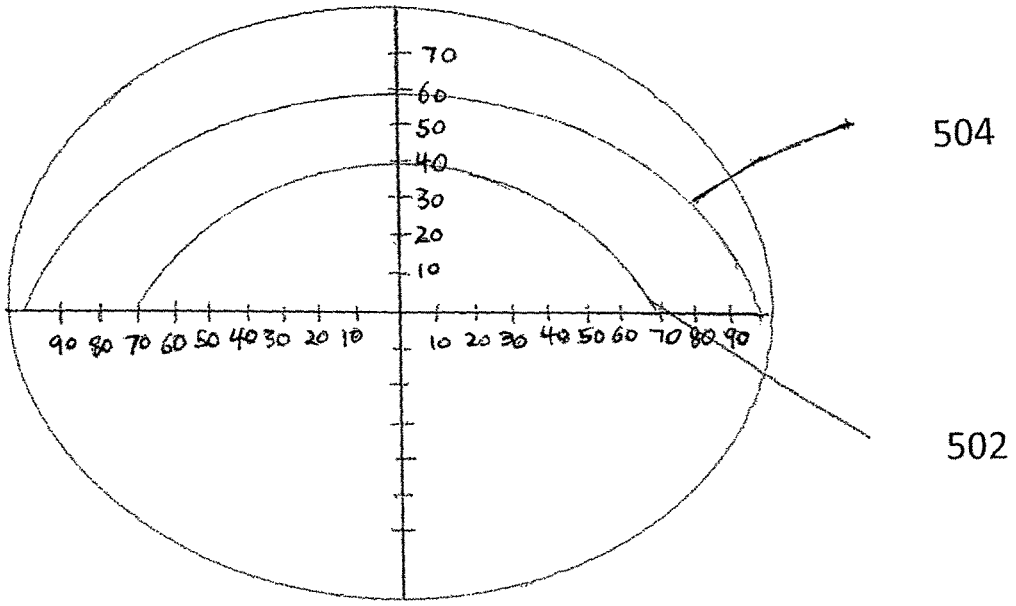
FIG. 5 depicts improvements in the visual field compared to the prior art made possible by the invention.

In summary, the improvement in visual field made possible by the invention should increase both functionality and safety. FIG. 5 depicts improvements in the visual field compared to the prior art made possible by the invention. Curved line 502 represents the visual field allowable by a prior-art helmet. Curve 504 illustrates the visual field made possible by the invention.

When used by athletes, helmets according to the invention enhance the wearer's ability to visualize and assess their surroundings to improve their safety. The invention also adds to, and enhances, the ability and performance of the game participants by offering better visualization of the ball, puck, defender, etc. Thus in athletic competition the game performance will improve by the use of this invention. In addition, in contact sports, safety will also improve by allowing the individual wearing the helmet to better see and avoid the impact commonly occurring in their sport.

In recreational, occupational and medical use, non-athletic helmets are quite popular among bicycle users, operators of motorcycles, drivers of racing cars, construction workers, public service workers such as police, military service personnel, and persons with special needs. In these areas as well, the helmets described herein will improve safety, functionality, and performance.

APPLICATIONS

1) Football Helmets
2) Hockey Helmets
3) Baseball Helmets
4) Bicycle Helmets
5) Motorcycle Helmets
6) Racing Car Helmets
7) Skiing Helmets
8) Snowboarding Helmets
9) Skateboarding Helmets
10) Water sport Helmets
11) Construction Helmets
12) Police Helmets
13) Firemen Helmets
14) Military service men Helmets
15) Special Needs Patient Helmets Additional Embodiments 1. Sensors are placed within the helmet in areas outside of the visual field.
2. The air lining, or foam padding may uniformly coat the head in one sheet to as reduce the rotational impact caused by collision with the helmet. This lining would remain transparent.
3. Newer transparent thermoplastics may be used for the shell material.

The invention claimed is:

1. An impact-protective helmet that provides a wearer an optimized visual field through the helmet, comprising:

a protective shell consisting of a single transparent layer of plastic or polymeric material having a concave inner surface and a convex outer surface configured to cover at least a top portion of a wearer's head and protect against impact;

at least one film on the shell which: (a) transmits sufficient light to enable a wearer to see through or perceive external shapes through the protective shell and the at least one film, and (b) reflects ambient light sufficient to impart a desired outer appearance to an outside observer; and wherein the at least one film is a metallized film on the concave inner surface or the convex outer surface of the shell to create a one-way mirror.

2. The helmet of claim 1, wherein the shell is made from polycarbonate.

3. The helmet of claim 1, further including a scratch-resistant layer.

4. The helmet of claim 1, including transparent, semi-transparent or translucent padding within the shell.

5. The helmet of claim 4, wherein the padding comprises a flexible plastic enclosure filled with air, water or gel.

6. The helmet of claim 1, including a face mask, shield or guard with portions constructed from a transparent, semi-transparent or translucent material.

7. The impact-protective helmet of claim 1, wherein the protective shell forms parts of a football helmet.

8. An impact-protective helmet that provides a wearer an optimized visual field through the helmet, comprising:

a protective shell consisting of a single transparent layer of plastic or polymeric material having a concave inner surface and a convex outer surface configured to cover at least a top portion of a wearer's head and protect against impact;

at least one coating on or in the shell which: (a) transmits sufficient light to enable a wearer to see through or perceive external shapes through the protective shell and the at least one coating, and (b) reflects ambient light sufficient to impart a desired outer appearance to an outside observer; and wherein the at least one coating is a metallized coating applied to the concave inner surface or the convex outer surface of the shell to impart a particular color to an outside observer.

9. The impact-protective helmet of claim 8, wherein the protective shell forms parts of a football helmet.

10. An impact-protective helmet that provides a wearer an optimized visual field through the helmet, comprising:

a protective shell consisting of a single transparent layer of plastic or polymeric material having a concave inner surface and a convex outer surface configured to cover at least a top portion of a wearer's head and protect against impact;

one or more coatings, films or layers on or in the shell which: (a) transmit sufficient light to enable a wearer to see through or perceive external shapes through protective shell and the one or more coatings, films or layers, and (b) reflect ambient light sufficient to impart a desired outer appearance to an outside observer; and wherein the one or more coatings, films or layers includes text or graphics formed with a microdot pattern.

11. The impact-protective helmet of claim 10, wherein the protective shell forms parts of a football helmet.

12. An impact-protective helmet that provides a wearer an optimized visual field through the helmet, comprising:

a protective shell consisting of a single transparent layer of plastic or polymeric material having a concave inner surface and a convex outer surface configured to cover at least a top portion of a wearer's head and protect against impact;

a plurality of dielectric transparent and light-absorbing layers on or in the shell which: (a) transmit sufficient light to enable a wearer to see through or perceive external shapes through protective shell and the layers, and (b) reflect ambient light sufficient to impart a desired outer appearance to an outside observer.

13. The helmet of claim 12, wherein the transparent layer is generally thicker than the light-absorbing layers.

14. The impact-protective helmet of claim 12, wherein the protective shell forms parts of a football helmet.

15. An impact-protective helmet that provides a wearer an optimized visual field through the helmet, comprising:

a protective shell consisting of a single transparent layer of plastic or polymeric material having a concave inner surface and a convex outer surface configured to cover at least a top portion of a wearer's head and protect against impact;

one or more coatings, films or layers on or in the shell which: (a) transmit sufficient light to enable a wearer to see through or perceive external shapes through the protective shell and the one or more coatings, films or layers, and (b) reflect ambient light sufficient to impart a desired outer appearance to an outside observer; and further including applied text or graphics that are at least semi-transparent.

16. The impact-protective helmet of claim 15, wherein the protective shell forms parts of a football helmet.

17. An impact-protective helmet that provides a wearer an optimized visual field through the helmet, comprising:

a protective shell consisting of a single transparent layer of plastic or polymeric material having a concave inner surface and a convex outer surface configured to cover at least a top portion of a wearer's head and protect against impact;

a plurality of layers composed of metal oxides, fluorides, or nitrides on or in the shell which: (a) transmit sufficient light to enable a wearer to see through or perceive external shapes through the protective shell and the layers, and (b) reflect ambient light sufficient to impart a desired outer appearance to an outside observer.

18. The impact-protective helmet of claim 17, wherein the protective shell forms parts of a football helmet.

* * * * *